US009660391B1

(12) United States Patent
Kim et al.

(10) Patent No.: US 9,660,391 B1
(45) Date of Patent: May 23, 2017

(54) ADAPTER HAVING A ROTATING MEMBER WITH A CONNECTOR PIN CONNECTED TO A PRINTED CIRCUIT BOARD

(71) Applicant: SAMSUNG ELECTRONICS CO., LTD., Suwon-si (KR)

(72) Inventors: Tae Hyuck Kim, Seoul (KR); Sung Jin Ann, Seoul (KR); Tae Hun Kim, Seoul (KR); Jin Ho Choi, Seoul (KR); Chang Geun Seo, Incheon (KR); Won Myung Woo, Seoul (KR); Ka San Ha, Goyang-si (KR); Sun Jin Park, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/168,851

(22) Filed: May 31, 2016

(30) Foreign Application Priority Data

Feb. 4, 2016 (KR) ..... 10-2016-0013867

(51) Int. Cl.

| | |
|---|---|
| ***H01R 39/00*** | (2006.01) |
| ***H01R 13/66*** | (2006.01) |
| ***H01R 13/502*** | (2006.01) |
| ***H01R 13/05*** | (2006.01) |
| ***H01R 35/04*** | (2006.01) |

(52) U.S. Cl.
CPC ..... *H01R 13/6675* (2013.01); *H01R 13/055* (2013.01); *H01R 13/502* (2013.01); *H01R 35/04* (2013.01)

(58) Field of Classification Search
CPC ..... H01R 25/00; H01R 24/54; H01R 27/02; H01R 31/06; H01R 33/88; H01R 33/94; H01R 33/22; H01R 33/971; H01R 35/00; H01R 35/025; H01R 35/04
USPC ..... 439/11, 13, 164, 300, 638
See application file for complete search history.

(56) References Cited

U.S. PATENT DOCUMENTS

| | | | | |
|---|---|---|---|---|
| 5,352,122 | A * | 10/1994 | Speyer | F21S 8/035 439/13 |
| 6,093,028 | A * | 7/2000 | Yang | H01R 39/64 362/641 |
| 6,793,499 | B1 * | 9/2004 | Chen | H01R 13/652 439/13 |
| 6,821,134 | B2 * | 11/2004 | Chen | H01R 35/04 439/11 |
| 7,125,257 | B1 * | 10/2006 | Liang | H01R 35/04 439/131 |
| 7,658,625 | B2 * | 2/2010 | Jubelirer | H01R 31/065 439/131 |

(Continued)

FOREIGN PATENT DOCUMENTS

KR 10-2002-0065232 A 8/2002

*Primary Examiner* — Chandrika Prasad
(74) *Attorney, Agent, or Firm* — Sughrue Mion, PLLC

(57) ABSTRACT

An adapter having a rotatable plug is provided. The adapter includes a case having an installation hole which provides access to an interior of the case; a rotation member installed within the installation hole of the case, the rotation member being rotatable within the installation hole relative to the case; at least one connection pin installed in the rotation member and protruding from the case; and a guide member provided adjacent to installation hole in the interior of the case and configured to guide rotation of the rotation member.

17 Claims, 17 Drawing Sheets

(56) References Cited

U.S. PATENT DOCUMENTS

| | | | | |
|---|---|---|---|---|
| 8,096,817 | B2 * | 1/2012 | Lee | H01R 29/00 439/104 |
| 8,342,861 | B2 * | 1/2013 | Stiehl | H01R 24/30 439/695 |
| 2002/0137394 | A1 * | 9/2002 | Chung Li | H01R 35/04 439/647 |
| 2009/0227122 | A1 * | 9/2009 | Jubelirer | H01R 31/065 439/11 |
| 2011/0053421 | A1 * | 3/2011 | Mostoller | H01R 13/562 439/625 |

* cited by examiner

ADAPTER HAVING A ROTATING MEMBER WITH A CONNECTOR PIN CONNECTED TO A PRINTED CIRCUIT BOARD

CROSS-REFERENCE TO RELATED APPLICATION

This application claims priority from Korean Patent Application No. 10-2016-0013867, filed on Feb. 4, 2016 in the Korean Intellectual Property Office, the disclosure of which is incorporated herein by reference.

BACKGROUND

1. Field

Apparatuses consistent with exemplary embodiments of the present disclosure relate to an adapter having a rotation structure configured to allow a plug to be rotatable.

2. Description of Related Art

In general, electronic devices have a different voltage according to the type of the electronic devices and the use thereof, and also the shape of an input unit in which the power is supplied is different according to each product.

Therefore, it may be needed that a voltage of the power that is appropriate to be used for the electronic device is supplied to supply the power to the electronic device, through a connector having the shape that is appropriate for the input unit/the shape that corresponds to the input unit, and a device configured to perform this function is an adapter that is power conversion supply apparatus.

Particularly, a power adapter has been widely used as a device configured to convert alternating current (AC) to direct current (DC) and supply DC to a variety of electronic devices using DC, e.g., a lap top, a PC, a display monitor, and a mobile phone. In addition, the power adapter has been used as a device configured to charge a battery or supply the power needed for the driving of the electronic devices, and a device configured to generate an output power from an input power.

The power adapter is provided with a body in which an AC/DC conversion voltage circuit is housed, a plug connected to a power electric outlet, and a connector connected to an electronic device, and is configured to convert a high voltage of AC into an appropriate voltage of DC and supply DC to the electric device.

When the power adapter is connected to a multi tap outlet, interference may occur with an adjacent electric outlet and thus there may be limitation in the usability of the multi tap outlet.

SUMMARY

One or more exemplary embodiments provide an adapter having a rotatable plug.

One or more exemplary embodiments also provide an adapter configured to improve user convenience by using a plug that is rotatable by angle and by step by step.

In accordance with an aspect of exemplary embodiment, there is provided an adapter including: a case having an installation hole which provides access to an interior of the case; a rotation member installed within the installation hole of the case, the rotation member being rotatable within the installation hole relative to the case; at least one connection pin installed in the rotation member and protruding from the case; and a guide member provided adjacent to installation hole in the interior of the case and configured to guide rotation of the rotation member.

The adapter may further include: a printed circuit board (PCB) provided in the interior of the case; and at least one wire connecting the connection pin to the PCB.

The guide member may include a cover comprising a wire accommodation unit in which the at least one wire is accommodated.

The cover may include at least one wire hole through which the at least one wire extends.

The at least one wire may include two wires that are twisted with each other at least one twist inside the wire accommodation unit.

The rotation member may include at least one rotation protrusion provided at an outer circumferential surface of the rotation member, and the guide member may include at least one rotation protrusion groove configured to receive the at least one rotation protrusion.

The case may include a case body and a case base configured to cover an opening formed in the case body, and the installation hole is formed within the case base.

The rotation member may include a first position indicator provided on an exterior surface of the rotation member, and the case may include at least one second position indicator provided on an exterior surface the case, the first position indicator and the at least one second position indicator being configured to indicate a rotation angle of the rotation member.

The at least one second position indicator may include two indicators spaced apart by 90 degrees.

The adapter may further include a plug configured to be coupled to the connection pin.

The rotation member may include at least one rotation groove unit provided at an outer circumferential surface of the rotation member, and the guide member may include at least one rotation protrusion unit disposed on a rotation path of the rotation groove unit, the at least one rotation groove unit being configured to receive the at least one rotation protrusion unit.

The at least one rotation protrusion unit may be provided at a position between 0 degrees and 90 degrees.

According to an aspect of another exemplary embodiment, there is provided an adapter including: a body; at least one connector protruding from the body; a plug connected to the connector; a printed circuit board (PCB) disposed inside the body; at least one wire connecting the connector to the PCB; and a connector holder configured to accommodate and support the connector, the connector holder being rotatably installed in the body such that the connector holder is rotatable relative to the body.

The adapter may further include a guide member provided in the body and comprising at least one protrusion groove, wherein the connector holder includes at least one rotation protrusion formed along an outer circumferential surface of the connecter holder, and the at least one protrusion groove is configured to receive the at least one rotation protrusion.

The adapter may further include a cover coupled to the guide member, wherein the cover includes a wire accommodation unit in which the at least one wire is accommodated, and the wire accommodation unit has at least one wire hole through which the at least one wire extends.

The at least one wire may include two wires that are twisted with each other at least one twist inside the wire accommodation unit.

The body further may include a stopper configured to limit rotation of the connector holder.

According to an aspect of another exemplary embodiment, there is provided an adapter including: a case; a connector a connector holder in which the connector is installed; and a cover configured to accommodate the connector holder inside the case, wherein the connector holder is rotatable relative to the case and the cover.

The cover may include a wire accommodation unit in which at least one wire is accommodated, and the wire accommodation unit has at least one wire hole through which the at least one wire extends.

The adapter may further include a printed circuit board disposed inside the case and connected to the connector via the at least one wire, wherein the at least one wire is twisted at least once within the cover.

BRIEF DESCRIPTION OF THE DRAWINGS

The above and/or other aspects will become apparent and more readily appreciated from the following description of exemplary embodiments, taken in conjunction with the accompanying drawings of which.

DETAILED DESCRIPTION

Hereinafter embodiments will be described with reference to drawings. In the following detailed description, the terms of "front end", "rear end", "upper portion", "lower portion", "upper end", "lower end" and the like may be defined by the drawings, but the shape and the location of the component is not limited by the term.

Figure 1:
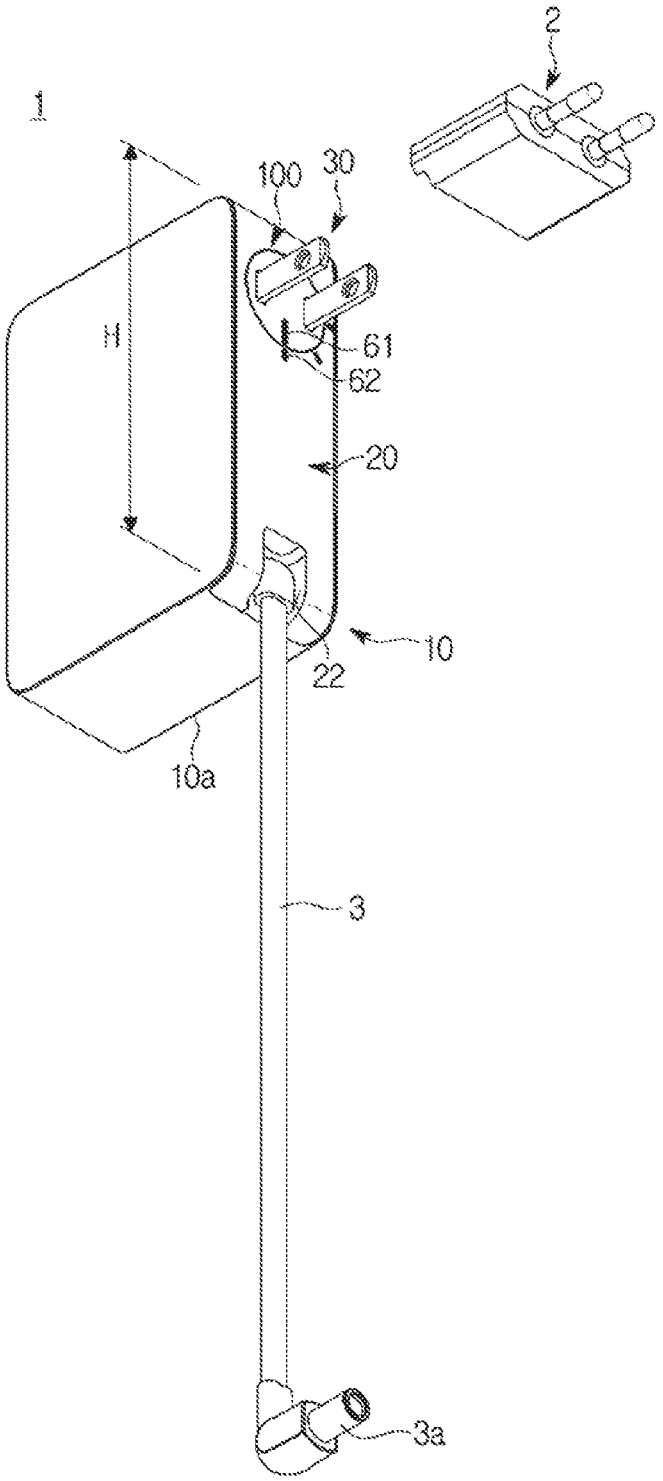
FIG. 1 is a view illustrating a plug and an adapter in accordance with an exemplary embodiment.
Figure 2:
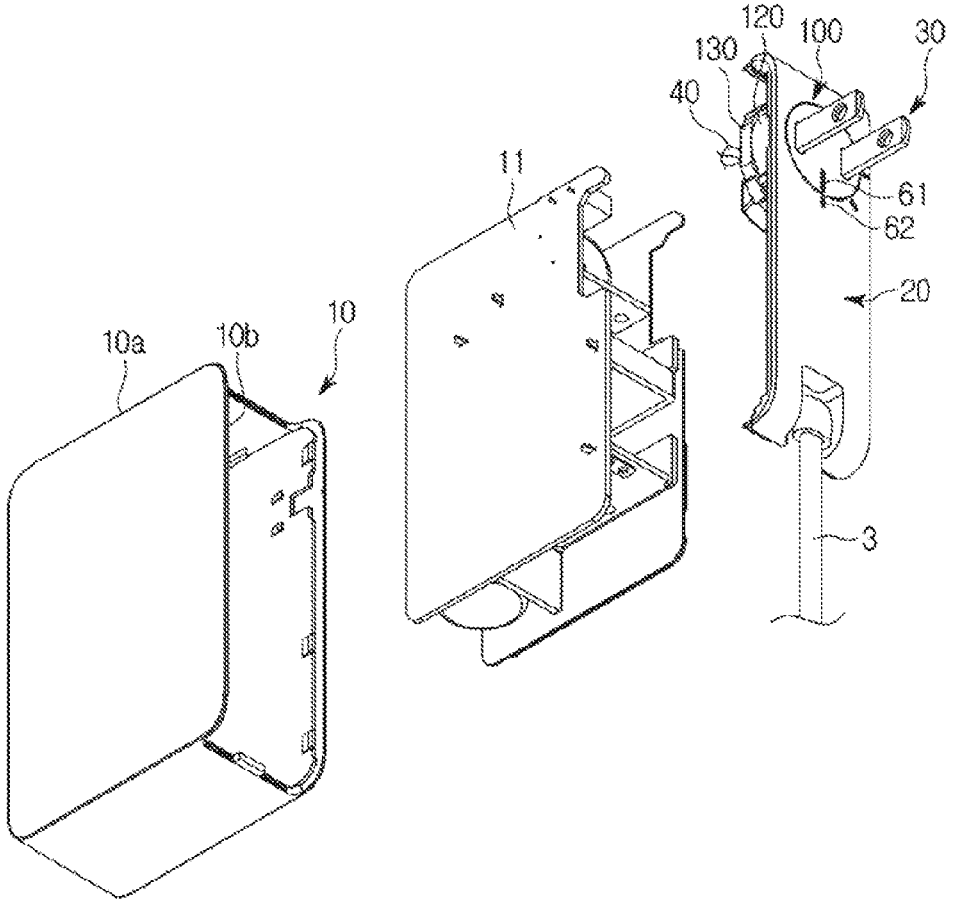
FIG. 2 is an exploded-perspective view illustrating an adapter in accordance with an exemplary embodiment.

FIG. 1 is a view illustrating a plug and an adapter in accordance with an exemplary embodiment, and FIG. 2 is an exploded-perspective view illustrating an adapter in accordance with an exemplary embodiment.

As illustrated in FIGS. 1 and 2, an adapter 1 may include a case 10, a connection pin 30 installed in the case 10, and a plug 2 coupled to the connection pin 30.

In general, an AC/DC adapter (hereinafter referred to as "adapter 1") that is used for 110V and 220V may represent a rectifier configured to convert commercial voltage, that is AC 110V/220V into a certain DC voltage. The adapter 1 may be configured to allow a user to selectively use both of AC 110V and 220V through a switch conversion, and thus a pair of 110V type connection pins (hereinafter referred to as "connection pin 30") may be protruded in the case 10 of the adapter 1 for the use of 110V power.

The case 10 of the adapter 1 may be formed in an approximate hexahedral shape to have a space unit in which a printed circuit board (PCB) 11 is installed. The case 10 may include a body 10*a* and a case base 20 coupled to the case body 10*a*.

The case body 10*a* may have a hexahedral shape and may include at least one opening 10*b*. According to an exemplary embodiment, the case 10 may have one surface of an upper surface or a lower surface open, but is not limited thereto.

The case body 10*a* may be formed of insulation resin material, and thus may protect components, e.g., the PCB 11, etc., accommodated in the inner space, from the outside.

The case base 20 may be provided in the opening 10*b* of the case body 10*a*. The case base 20 may be provided to cover the opening 10*b* of the case body 10*a*. The case base 20 may be generally formed in a plate shape. A power line installation unit 22 to which the power line 3 that is configured to connect the adapter 1 to an electric device is connected may be formed in a lower end portion of the case base 20. The power line 3 may include an electric terminal 3*a* for connection with an electric device, particularly the electric terminal 3*a* is provided in a lower portion of the power line 3.

In the case base 20, a rotation member 100 in which at least one connection pin 30 is provided may be rotatably installed.

Figure 3:
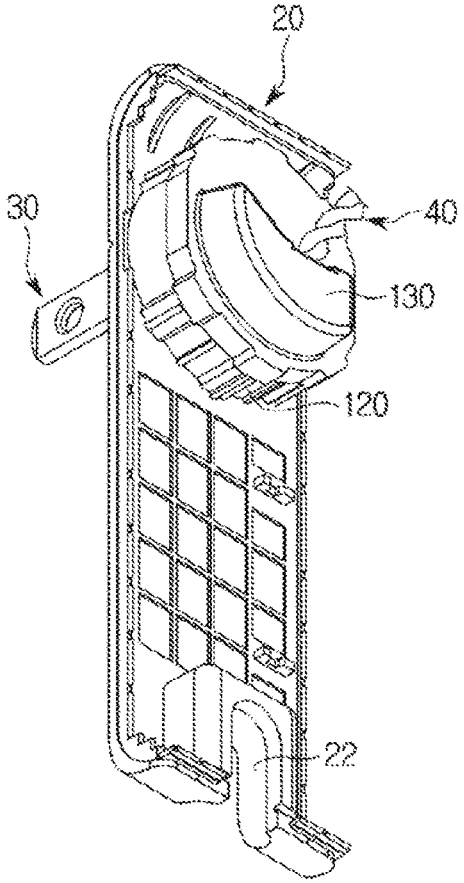
FIG. 3 is a view illustrating a connection pin rotatably installed in an adapter in accordance with an exemplary embodiment.
Figure 4:
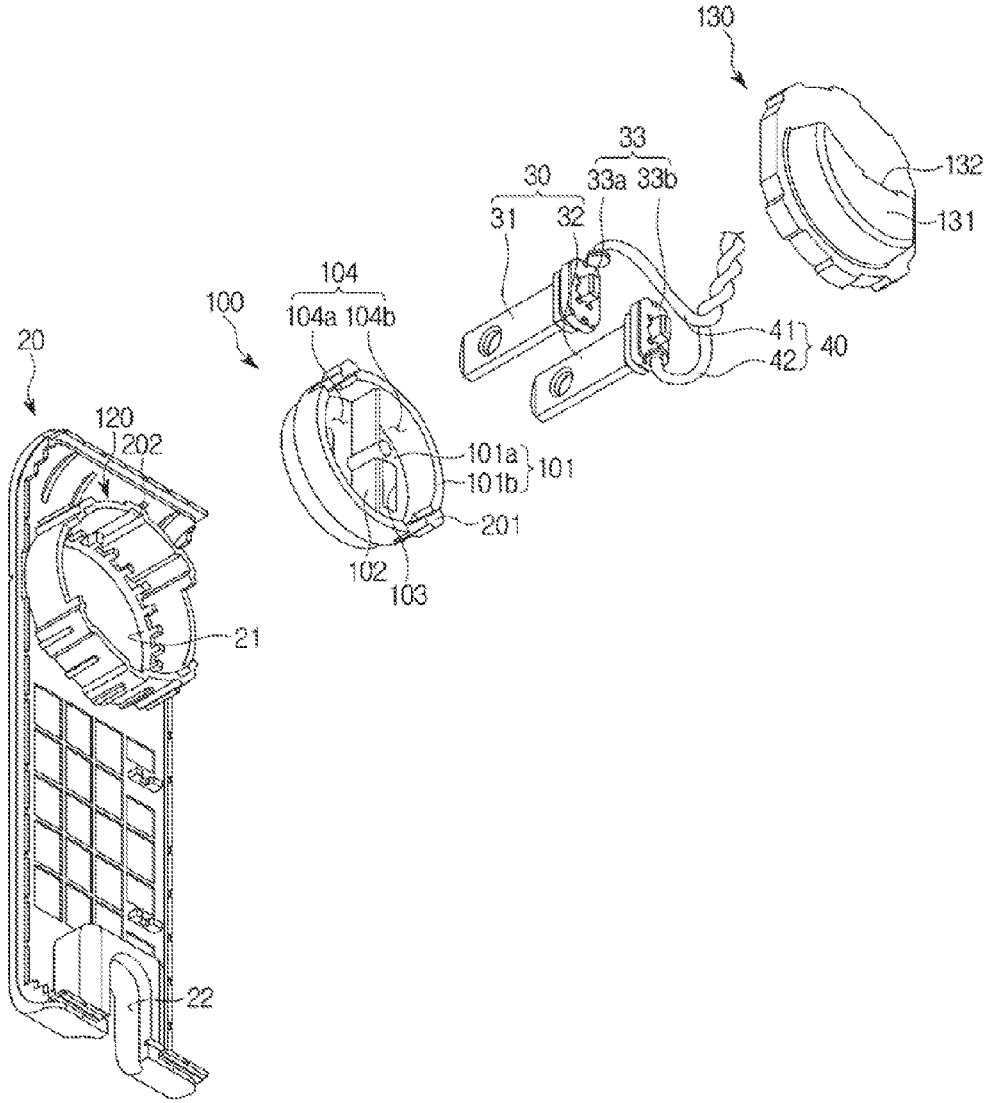
FIG. 4 is an exploded-perspective view illustrating a connection pin rotatably installed in a case base in accordance with an exemplary embodiment.
Figure 5:
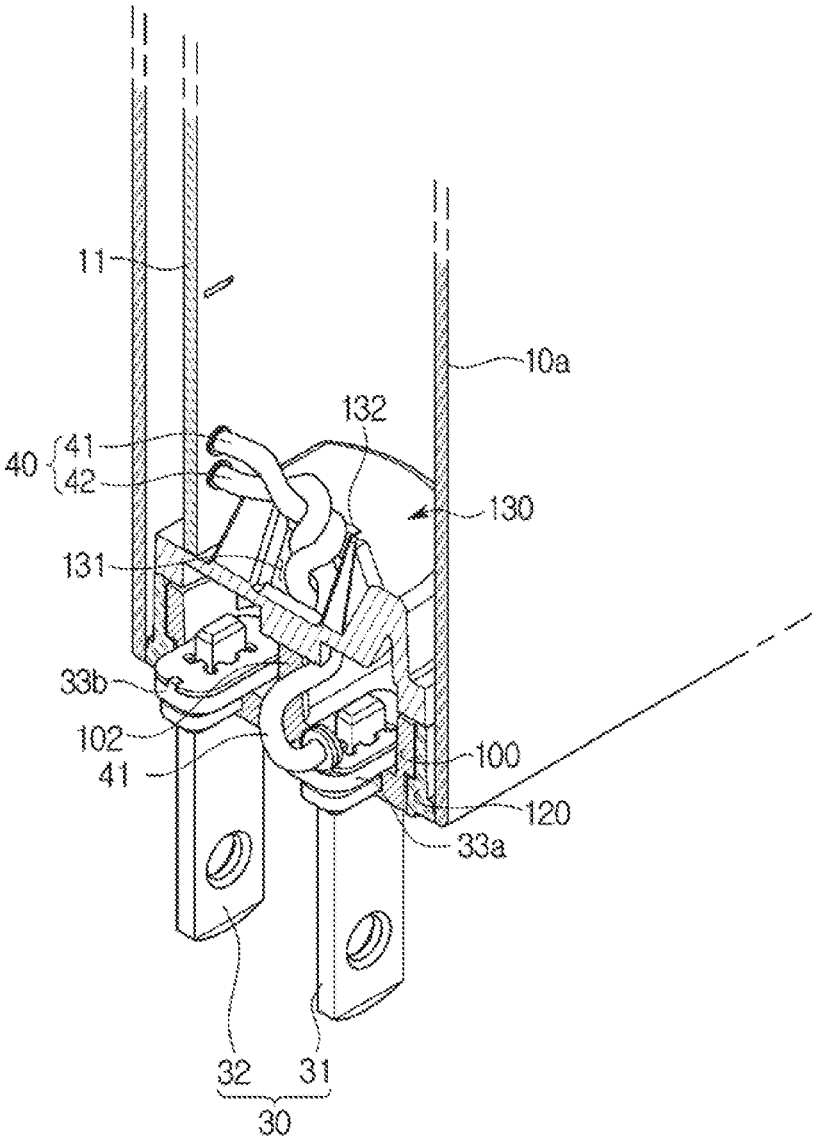
FIG. 5 is a partial cross-sectional view illustrating a connection pin, a rotation member, a guide member and a cover in accordance with an exemplary embodiment.

FIG. 3 is a view illustrating a connection pin rotatably installed in an adapter in accordance with an exemplary embodiment, FIG. 4 is an exploded-perspective view illustrating a connection pin rotatably installed in a case base in accordance with an exemplary embodiment, and FIG. 5 is a partial cross-sectional view illustrating a connection pin, a rotation member, a guide member and a cover in accordance with an exemplary embodiment.

As illustrated in FIGS. 3-5, at least one connection pin 30 rotatably installed in the case base 20 may be provided. The connection pin 30 may be a pair of connection pins 30, particularly one of the pair of the connection pins 30 may be provided in the left side and the right side, respectively. The connection pins 30 may include a first pin 31 provided in the right side, and a second pin 32 provided in the left side. The first pin 31 and the second pin 32 may be provided in parallel to each other. The first pin 31 and the second pin 32 may be formed of conductive material and formed in a stick shape. One end portion of the first pin 31 and the second pin 32 may be coupled to the case base 20 and the other end portion thereof may be exposed to the outside of the case base 20. The first pin 31 and the second pin 32 exposed to the outside of the case base 20 may be coupled to the plug 2 and then inserted into an electric outlet 300 thereby being supplied with the power (refer to FIG. 9).

The first pin 31 and the second pin 32 may be connected to a wire 40 via a connection member 33. The connection member 33 may include a first connection unit 33*a* connected to the first pin 31 and a second connection unit 33*b* connected to the second pin 32. Each of the connection pins 30 may be physically connected to the wire 40 via the connection member 33.

At least one wire 40 may be provided. The wire 40 may include a first wire 41 connected to the first pin 31 via the first connection unit 33*a* and a second wire 42 connected to the connection member 33 via the second connection unit 33*b*.

In this case, the first connection unit 33*a* and the second connection unit 33*b* may be disposed in a direction that is symmetrical with each other. According to a symmetrical position of the first connection unit 33*a* and the second connection unit 33*b*, the first wire 41 and the second wire 42 connected to the first connection unit 33*a* and the second connection unit 33*b*, respectively may be also disposed in a direction that is symmetrical with each other. According to an exemplary embodiment, the first connection unit 33*a* and the second connection unit 33*b* may be disposed in a direction that is symmetrical with each other, but is not limited thereto. For example, the first connection unit and the second connection unit may be disposed to be parallel to each other.

The first pin 31 and the second pin 32 may be connected to the PCB 11 placed inside of the case body 10*a* via the connection member 33 and the wire 40 so that the first pin 31 and the second pin 32 may be physically and electrically connected to the PCB 11.

The connection pin 30 may be rotatably installed in the case base 20 via the rotation member 100.

The rotation member 100 may be relatively rotatable against the case base 20, and may include at least one connection pin 30. The rotation member 100 may include a rotation body 101. The rotation body 101 may have a cylindrical shape. The rotation body 101 may include a first body 101*a* having a circular plate shape and a second body 101*b* having a ring shape.

A pin installation hole 103 may be provided in the first body 101*a* so that the first pin 31 and the second pin 32 are inserted thereto. At least one of the pin installation hole 103 may be provided so that the first pin 31 and the second pin 32 are inserted thereto, respectively. The pin installation hole 103 may be provided in a pair so that the first pin 31 and the second pin 32 are inserted thereto, respectively. The pin installation hole 103 may be formed in a way that a pair of the pin installation holes 103 is disposed to be parallel to each other so that the first pin 31 and the second pin 32 are disposed to be parallel to each other.

The second body 101*b* may be extended from an edge of the first body 101*a*. The second body 101*b* may form a wire installation unit 104 provided to be divided in the inside.

The rotation member 100 may include one or more rotation protrusions 201. The rotation protrusions 201 may be formed apart from each other in a circumferential direction on an outer circumferential surface of the second body 101*b*. For example, two rotation protrusions 201 may be disposed to be symmetrical with and face each other. Although two rotation protrusions 201 are provided in the exemplary embodiment, embodiments are not limited thereto.

The wire installation unit 104 may include a first wire installation unit 104*a* in which the first pin 31, the first connection unit 33*a* and the first wire 41 are installed and a second wire installation unit 104*b* in which the second pin 32, the second connection unit 33*b* and the second wire 42 are installed.

The first wire installation unit 104*a* and the second wire installation unit 104*b* may be divided into by a partition wall 102. The partition wall 102 may be provided between the first wire installation unit 104*a* and the second wire installation unit 104*b*. The partition wall 102 may allow the first wire installation unit 104*a* and the second wire installation unit 104*b* to be symmetrical. The partition wall 102 may be disposed on the center of the second body 101*b*. A rotation axis (C) may be formed in the center of the partition wall 102, wherein the rotation axis (C) becomes the center of the rotation when the rotation member 100 is rotated.

Therefore, the first pin 31 passing through the pin installation hole 103 formed in the first wire installation unit 104*a* of the rotation member 100 may be installed in the first wire installation unit 104*a* together with the first connection unit 33*a* and the first wire 41, and the second pin 32 passing through the pin installation hole 103 formed in the second wire installation unit 104*b* may be installed in the second wire installation unit 104*b* together with the second connection unit 33*b* and the second wire 42.

In this case, the first wire 41 connected to the first connection unit 33*a* and the second wire 42 connected to the second connection unit 33*b* may be divided by the partition wall 102 and thus it may be prevented that the first wire 41 makes contact with the second wire 42 when a wire is disconnected from the connection unit.

An installation hole 21 may be formed in the case base 20 so that the rotation member 100 is rotatably installed thereto. The installation hole 21 may be formed to pass through at least one portion of the case base 20. The installation hole 21 may have the size and the shape corresponding to the rotation member 100 to allow the rotation member 100 to be rotatably installed.

Therefore, the rotation member 100 in which the connection pin 30 is coupled thereto via the installation hole 21 of the case base 20 may be protruded to the outside of the case base 20 so as to be exposed to the outside, and the connection pin 30 that is exposed to the outside of the case base 20 may be coupled to a plug 2 that is detachably provided.

The plug 2 may be formed of an insulation material. A plug terminal formed of conductive material may be provided in the plug 2 so that the plug 2 may be connected to the connection pin 30. The plug terminal may be connected to the connection pin 30 of the adapter 1 to allow the plug 2 and the adapter 1 to be physically and electrically connected.

A guide member 120 configured to guide the rotation of the rotation member 100 may be provided on a rear surface of the installation hole 21 of the case base 20. The guide member 120 may be formed to correspond to the size and the shape of the installation hole 21.

The guide member 120 may be formed in a circular ring shape. The guide member 120 may be formed to have the size and the shape corresponding to the rotation member 100 so that the rotation member 100 is inserted into an inner circumferential surface of thereof and then rotated. According to an exemplary embodiment, the guide member 120 may be integrally formed with the case base 20, but is not limited thereto. For example, the guide member 120 may be separately provided from the case base 20.

The guide member 120 may include one or more rotation protrusion grooves 202 that are provided to correspond to the one or more rotation protrusions 201 of the rotation member 100. At least one of the rotation protrusion grooves 202 of the guide member 120 is provided between 0 (zero) degrees and 90 degrees about the rotation axis (C).

Figure 6:
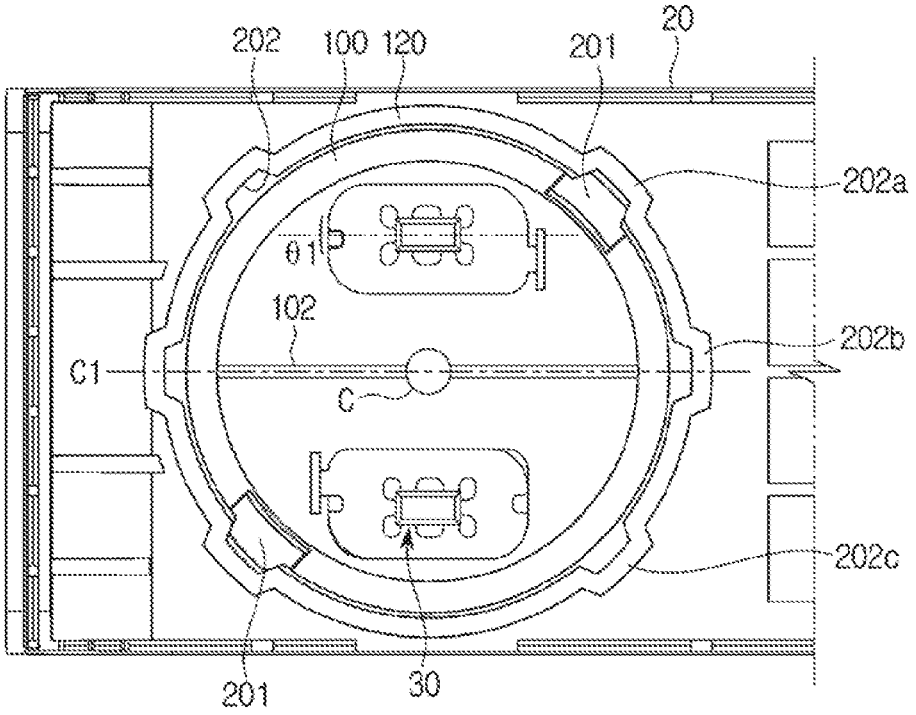
FIGS. 6-8 are views illustrating a rotation motion of a rotation member in accordance with an exemplary embodiment.
Figure 7:
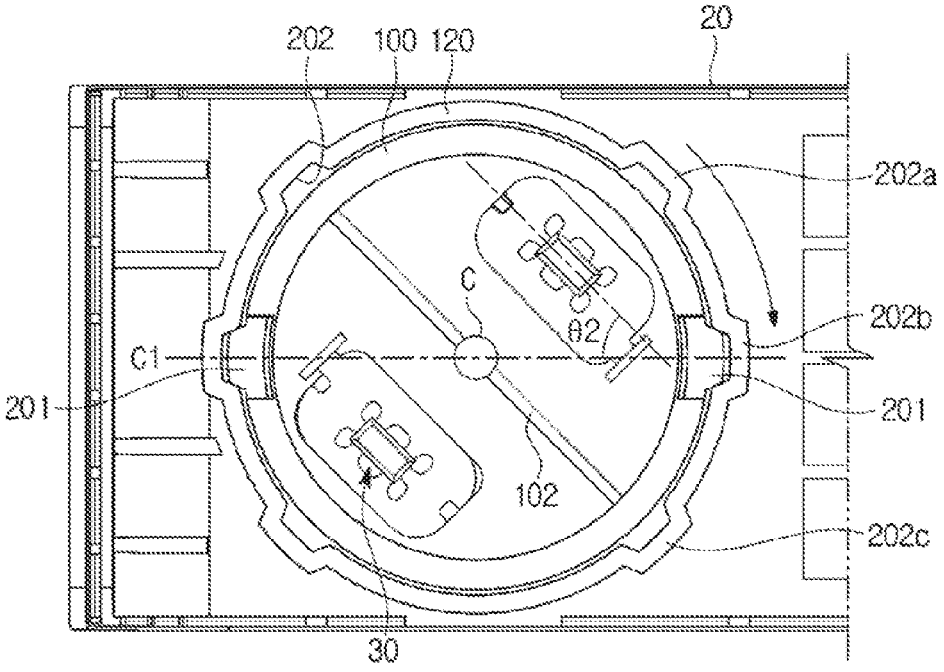
Figure 8:
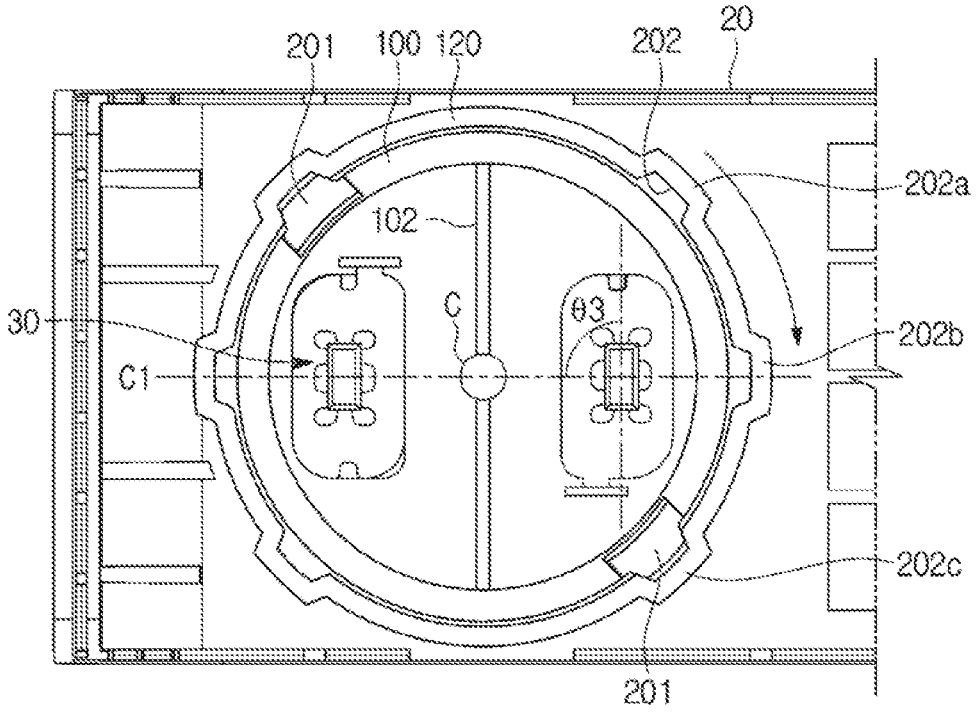

The rotation protrusion grooves 202 of the guide member 120 may include a first rotation protrusion groove 202*a*, a second rotation protrusion groove 202*b*, and a third rotation protrusion groove 202*c*. As shown in FIGS. 6, 7 and 8, the first rotation protrusion groove 202*a* may be formed to allow the connection pin 30 to be in an angular position (θ1) relative to a plane (C1) of the case body 10*a* in which the connection pin 30 is disposed parallel to (0 (zero) degrees)

a the plane (C1) while the connection pin 30 is not rotated. The second rotation protrusion groove 202*b* may be formed to allow the connection pin 30 to be in an angular position (θ2) relative to the plane (C1) and the first rotation protrusion groove 202*a*. The third rotation protrusion groove 202*c* may be formed to allow the connection pin 30 to be in an angular position (θ3) relative to a plane C1 and the first rotation protrusion groove 202*a*.

During the rotation member 100 is rotated, the rotation protrusion 201 may be coupled and fixed to at least one of the rotation protrusion grooves 202 of the guide member 120.

A cover 130 may be provided in the rear side of the guide member 120. A wire accommodation unit 131 in which at least one wire 40 is accommodated may be provided in the cover 130. The wire accommodation unit 131 includes a wire hole 132 through which the at least one wire 40 extends such that the at least one wire 40 may be connected to the PCB 11.

The at least one wire 40 may be crossed to form a twisted shape. The first wire 41 and the second wire 42 may be crossed with each other inside of the wire accommodation unit 131 so as to be formed in a twisted shape having at least one twist.

The wire accommodation unit 131 of the cover 130 may be formed to have a certain space unit to allow the at least one wire 40 to be twisted and placed therein. The wire accommodation unit 131 may be formed to have a certain height that is a height of the twisted at least one wire, or more than the height so that the at least one wire 40 is disposed to be in the twisted shape.

The cover 130 may accommodate and support the at least one wire 40 in the wire accommodation unit 131 to protect the wire 40 to prevent the disconnection and the connection of the wire 40. The cover 130 may be coupled to the guide member 120 in the rear side of the guide member 120. The cover 130 may be fixed to the guide member 120 to accommodate the rotation member 100 inside of the guide member 120.

FIGS. 6-8 are views illustrating a rotation motion of a rotation member in accordance with an exemplary embodiment.

As illustrated in FIGS. 6-8, a state of the connection pin 30 according to a rotation motion of the rotation member 100 and the guide member 120 will be described.

The rotation protrusion grooves 202 of the guide member 120 may include the first rotation protrusion groove 202*a*, the second rotation protrusion groove 202*b*, and the third rotation protrusion groove 202*c*.

The first rotation protrusion groove 202*a* may be formed to allow the connection pin 30 to be in a position (an initial position and 0 (zero) degrees) in which the connection pin 30 is disposed to be parallel to the plane (C1) of the case body 10*a* while the connection pin 30 is not rotated.

The second rotation protrusion groove 202*b* may be formed apart with a certain angle (45 degrees from the initial position) from the first rotation protrusion groove 202*a*. When the rotation protrusion 201 of the rotation member 100 is placed in the second rotation protrusion groove 202*b*, the connection pin 30 may be moved together with the rotation member 100 and then rotated with a certain angle.

The third rotation protrusion groove 202*c* may be formed apart with a certain angle (90 degrees from the initial position) from the second rotation protrusion groove 202*b*. When the rotation protrusion 201 of the rotation member 100 is placed in the third rotation protrusion groove 202*c*, the connection pin 30 may be moved together with the rotation member 100 and then rotated with a certain angle.

The rotation member 100 may include a first position indicator 61 configured to indicate a rotation state. The first position indicator 61 may be formed on an outer surface of the first body 101*a* of the rotation member 100. When the rotation protrusion 201 of the rotation member 100 is coupled to the first rotation protrusion groove 202*a* of the guide member 120, the first position indicator 61 may be displayed to be parallel to the height (H) of the case body 10*a*.

A second position indicator 62 corresponding to the first position indicator 61 may be formed in the case base 20. The second position indicator 62 may be formed adjacent to an outer circumference of the rotation member 100 to display a rotation angle of the rotation member 100. According to an exemplary embodiment, the second position indicator 62 may include a plurality of graduations, e.g., 0 (zero) degrees, 45 degrees, 90 degrees, etc., but embodiments are not limited thereto.

Figure 9:
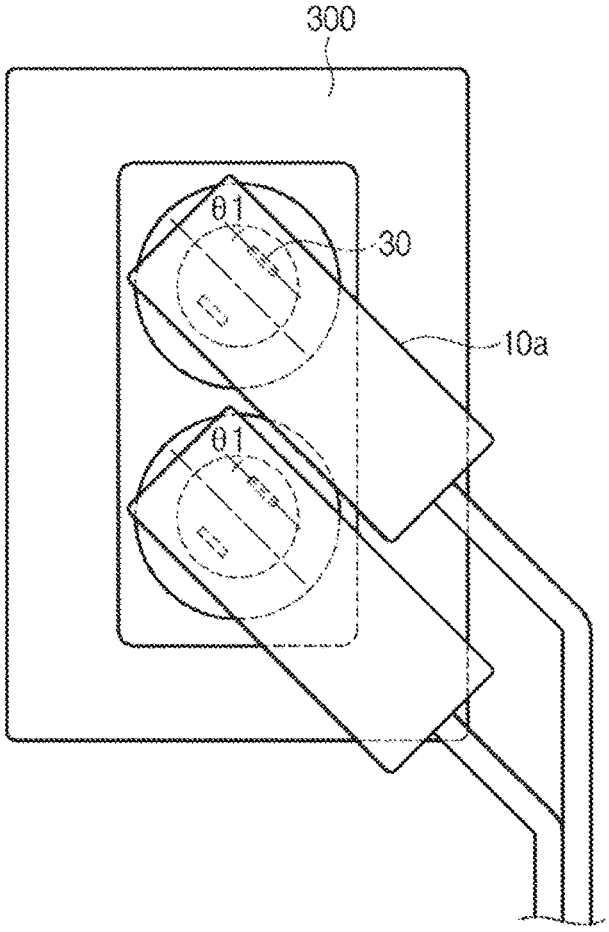
FIGS. 9, 10 and 11 are views illustrating a variation of a rotation angle of a connection pin according to rotation of a rotation member, and an installation state of an adapter according to the variation of the rotation angle in accordance with an exemplary embodiment.
Figure 10:
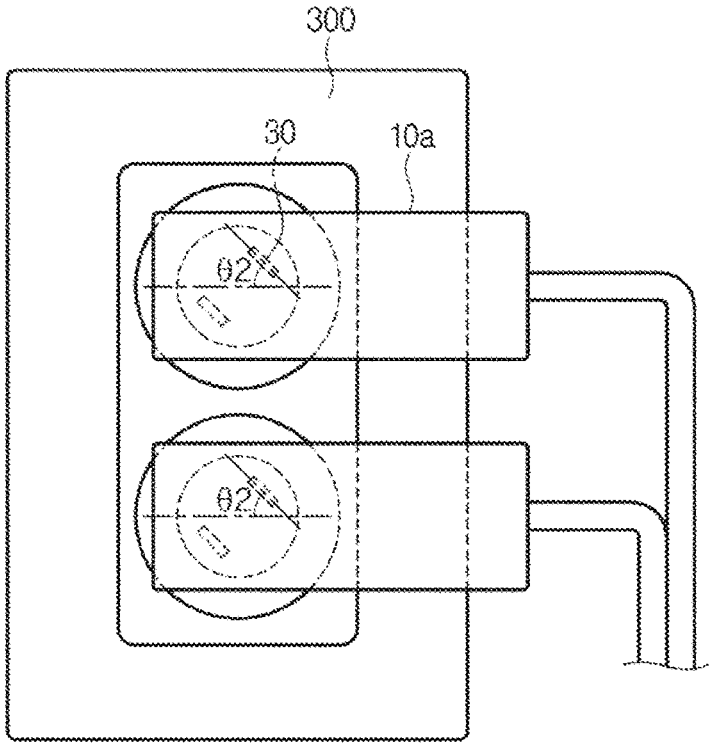
Figure 11:
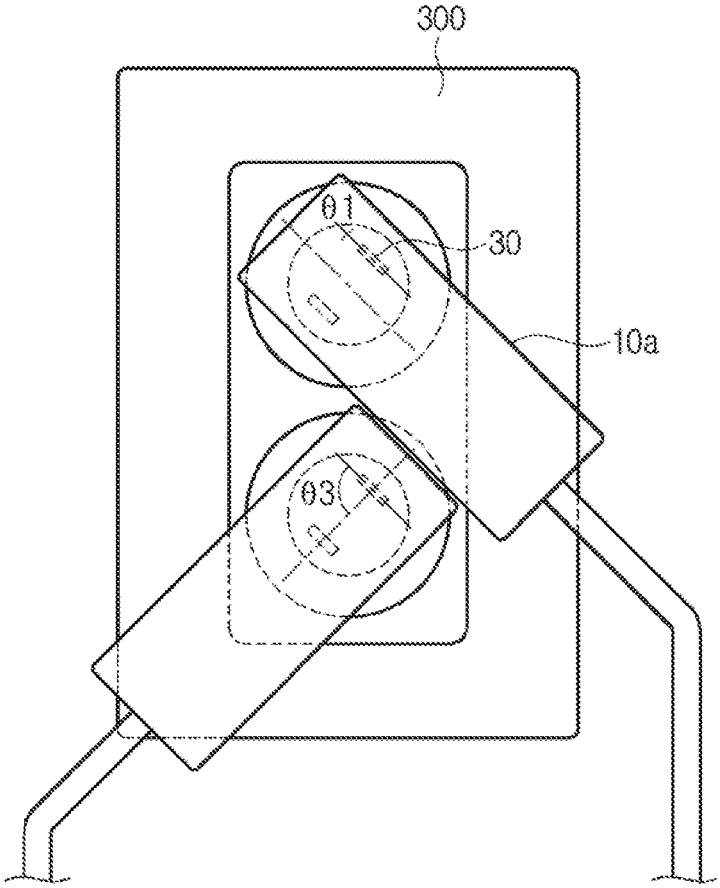

FIGS. 9-11 are views illustrating a variation of a rotation angle of a connection pin according to a rotation of a rotation member, and an installation state of an adapter according to the variation of the rotation angle in accordance with an exemplary embodiment.

As illustrated in FIGS. 9-11, the adapter 1 that is configured to receive the power by being inserted into an electric outlet 300 provided in the outside may include the connection pin 30 that is rotatably installed thereto.

In general, the electric outlet 300 may be a device configured to allow electricity to be transferred in a way that the connection pin 30 or the plug 2 is inserted thereinto, and may be provided to allow a plurality of the connection pin 30 or the plug 2 to be inserted thereinto at the same time. In this case, the electric outlet 300 may be disposed to be parallel to each other so that a plurality of the connection pin 30 or the plug 2 is inserted thereinto at the same time.

According to an exemplary embodiment, a plurality of the adapters 1 may be installed in the electric outlet 300, which is disposed to be parallel to each other, in a variety of directions due to the connection pin 30 that is rotatable, and thus the adapter 1 may be not interfered with each other.

For example, according to an embodiment, the adapters 1 may be installed in a state, wherein the state includes a basic arrangement state in which the rotation members 100 are not rotated (refer to FIG. 9), a state in which the rotation members 100 are rotated with a certain angle (θ2) and thus the connection pin 30 is installed in the electric outlet 300 while the connection pin 30 is rotated with 45 degree (refer to FIG. 10), and a proper combination state of a state in which the rotation member 100 is not rotated and a state in which the other rotation member 100 is rotated with a certain angle (θ3) and thus the connection pin 30 is installed in the electric outlet 300 while the connection pin 30 is rotated with 90 degree (refer to FIG. 11).

Therefore, the usability of the adapter 1 may be improved since there may be no limitation in the size and the installation direction of the adapter 1.

Figure 12:
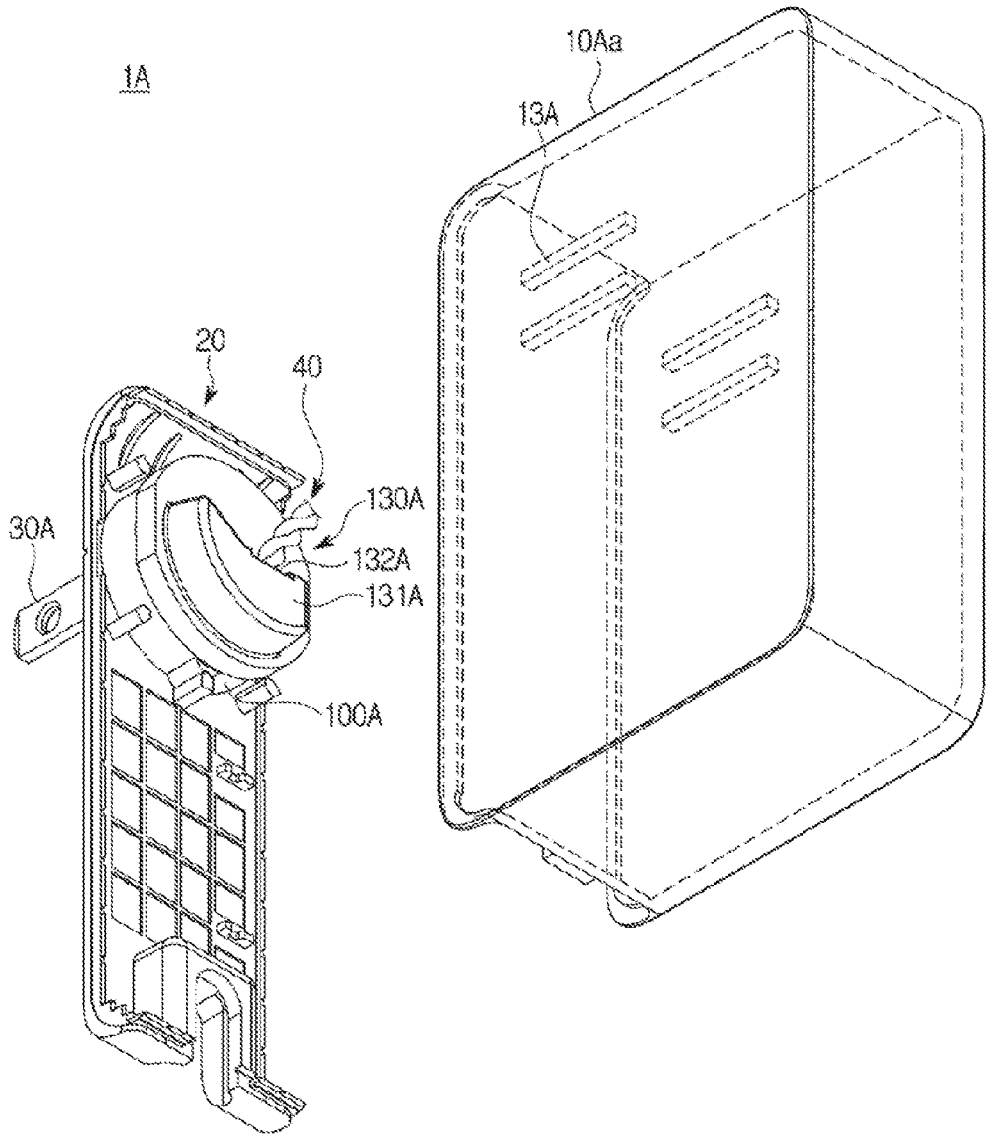
FIG. 12 is a partially exploded-perspective view illustrating an adapter in accordance with an exemplary embodiment.
Figure 13:
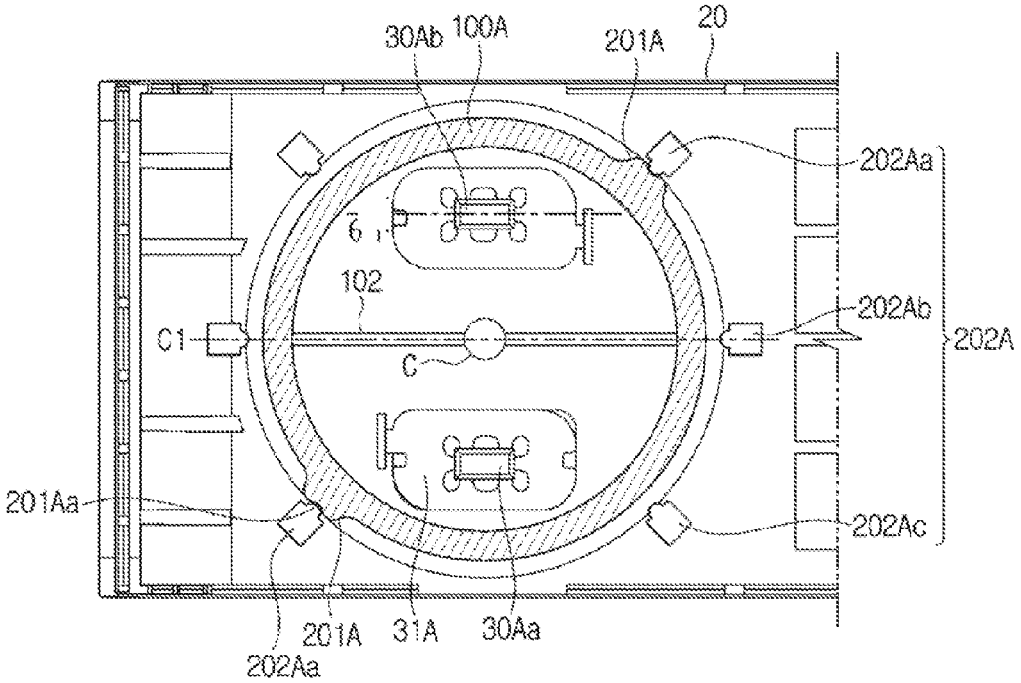
FIGS. 13 and 14 are views illustrating a rotation motion of a connector holder in accordance with an exemplary embodiment.
Figure 14:
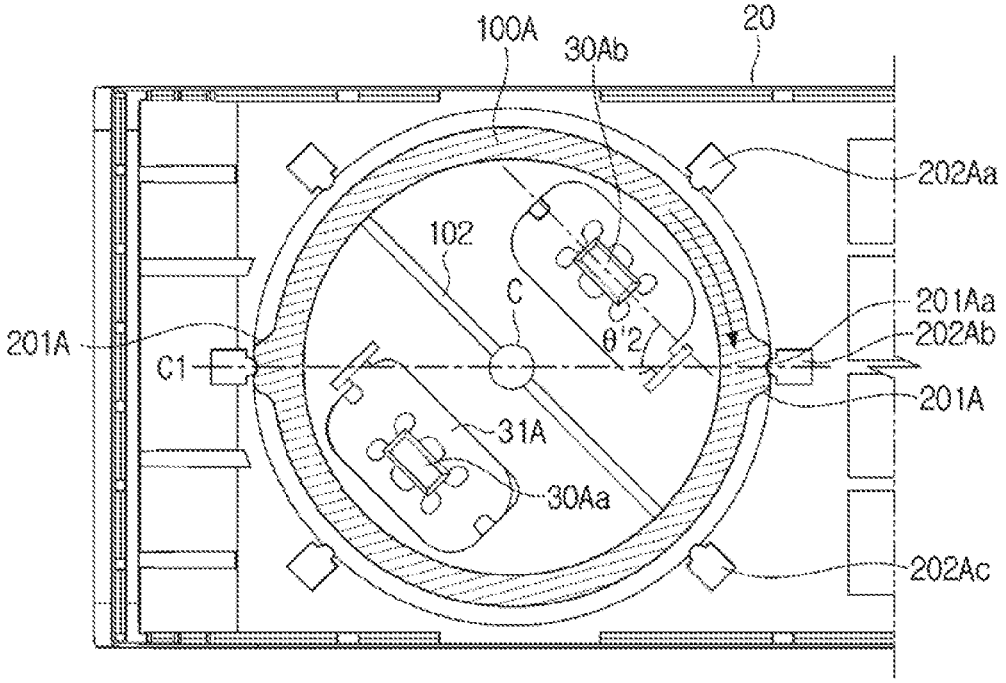

FIG. 12 is a view illustrating a connector rotatably installed in an adapter in accordance with an exemplary embodiment, and FIGS. 13 and 14 are views illustrating a rotation motion of a connector holder in accordance with another embodiment. Reference numerals that are not illustrated in the drawings may refer to FIGS. 1-11.

As illustrated in FIGS. 12, 13 and 14, an adapter 1A may include at least one connector 30A rotatably installed in a case body 10Aa.

The adapter 1A may include the case body 10Aa, the connector 30A protruded toward the outside of the case body 10Aa, and a plug 2 connected to the connector 30A.

The connector 30A may include a first connection pin 30Aa and a second connection pin 30Ab are provided in the left side and the right side, respectively. The first connection pin 30Aa and the second connection pin 30Ab may be provided in parallel to each other. The first connection pin 30Aa and the second connection pin 30Ab may be formed of conductive material and formed in a stick shape.

The connector 30A may be coupled by a connector holder 100A. One end portion of the connector 30A may be rotatably installed to the case base 20 by the connector holder 100A, and the other end portion thereof may be exposed to the outside of the case base 20. The first connection pin 30Aa and the second connection pin 30Ab exposed to the outside of the case base 20 may be coupled to the plug 2 and then inserted into an electric outlet 300 thereby being supplied with the power.

The connector 30A may be connected to a connector connection unit 31A via a wire 40. The connector 30A may be connected to a PCB 11 inside of the case body 10Aa via the connector connection unit 31A so as to be physically and electrically connected to the PCB 11.

The connector holder 100A may be provided to be relatively rotatable against the case body 10Aa, and may accommodate and support the connector 30A. The connector holder 100A may be provided to be relatively rotatable against the case base 20. The connector holder 100A may be formed in a cylindrical shape. The connector holder 100A may include a pin installation hole 103 to allow the connector 30A to be inserted thereto. In an edge of the connector holder 100A, at least one rotation groove unit 201A may be formed apart from each other in a circumferential direction of the connector holder 100A. The rotation groove unit 201A may include a groove 201Aa recessed inward of the rotation groove unit 201A. The at least one of the rotation groove unit 201A may be formed on an outer circumferential surface of the connector holder 100A in an outward direction. For example, two rotation groove units 201A may be provided to be symmetrical with and to face each other. According to the exemplary embodiment, two rotation groove units 201A may be provided to face to each other, but embodiments are not limited thereto.

On a rear surface of the installation hole 21 of the case base 20, a rotation protrusion unit 202A configured to guide a rotation of the connector holder 100A may be provided. The rotation protrusion unit 202A may be disposed on a rotation path of the connector holder 100A. The rotation protrusion unit 202A may include a plurality of protrusions 202Aa, 202Ab, and 202Ac. The protrusions 202Aa, 202Ab, and 202Ac of the rotation protrusion unit 202A may be formed to have a shape corresponding to the groove 201Aa formed in the rotation groove unit 201A.

At least one of the protrusions 202Aa, 202Ab, and 202Ac of the rotation protrusion unit 202A may be provided. At least one of the protrusions 202Aa, 202Ab, and 202Ac of the rotation protrusion unit 202A is provided between 0 (zero) degrees and 90 degrees.

The protrusions 202Aa, 202Ab, and 202Ac of the rotation protrusion unit 202A may include a first rotation protrusion 202Aa, a second rotation protrusion 202Ab, and a third rotation protrusion 202Ac. The first rotation protrusion 202Aa may be formed to allow the connector 30A installed in the connector holder 100A to be in a position (θ'1) in which the connector 30A is disposed to be parallel to a plane (C1) of the case body 10Aa (0 (zero) degrees) while the connector 30A is not rotated. The second rotation protrusion 202Ab may be formed apart with a certain angle (θ'2) from the first rotation protrusion 202Aa, and the third rotation protrusion groove 202Ac may be formed apart with a certain angle (θ'3) from the first rotation protrusion 202Aa.

As the connector holder 100A is rotated, the rotation groove unit 201A may be coupled to at least one of protrusion of the rotation protrusion unit 202A so that a position of the connector holder 100A may be fixed.

A cover 130A may be provided in the rear side of the connector holder 100A. A wire accommodation unit 131A in which at least one wire 40 is accommodated may be provided in the cover 130A. The wire accommodation unit 131A includes a wire hole 132A through which the at least one wire 40 extends such that the at least one wire 40 may be connected to the PCB 11.

The at least one wire 40 may be crossed to form a twisted shape. The first wire 41 and the second wire 42 may be crossed with each other inside of the wire accommodation unit 131A so as to be formed in a twisted shape having at least one twist.

The wire accommodation unit 131A of the cover 130A may be formed to have a certain space unit to allow the at least one wire 40 to be twisted and placed therein. The wire accommodation unit 131A may be formed to have a certain height that is a height of the twisted at least one wire, or more than the height so that the at least one wire 40 is disposed to be in the twisted shape.

The cover 130A may be fixed by a fixation protrusion 13A formed inside of the case body 10Aa. The cover 130A may be fixed by the fixation protrusion 13A to accommodate and support the connector holder 100A.

An installation hole 21 may be formed in the case base 20 to allow the connector holder 100A to be rotatably installed. The installation hole 21 may be formed to pass through at least one portion of the case base 20. The installation hole 21 may be formed to have the size and the shape corresponding to the connector holder 100A so that the connector holder 100A may be rotatably installed therein.

Figure 15:
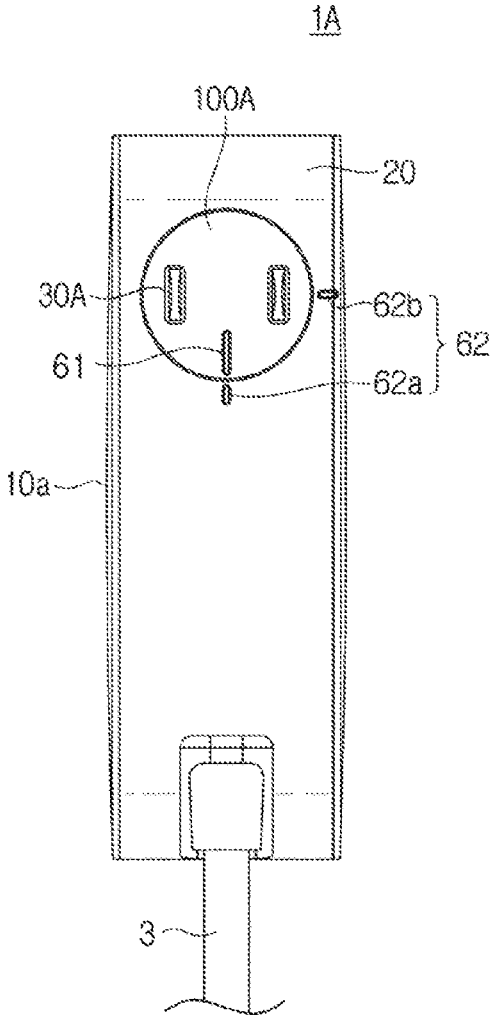
FIGS. 15, 16 and 17 are views illustrating a rotation step of a connector in accordance with exemplary embodiments.
Figure 16:
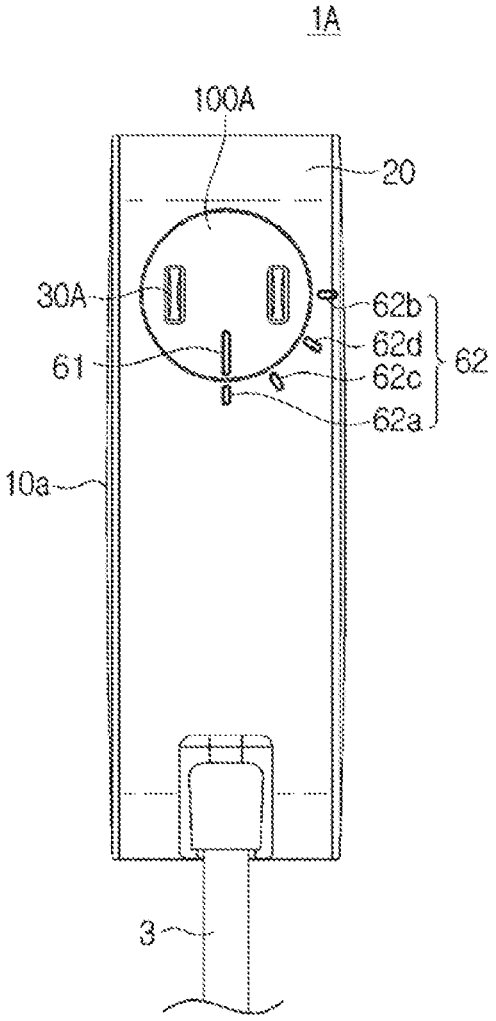
Figure 17:
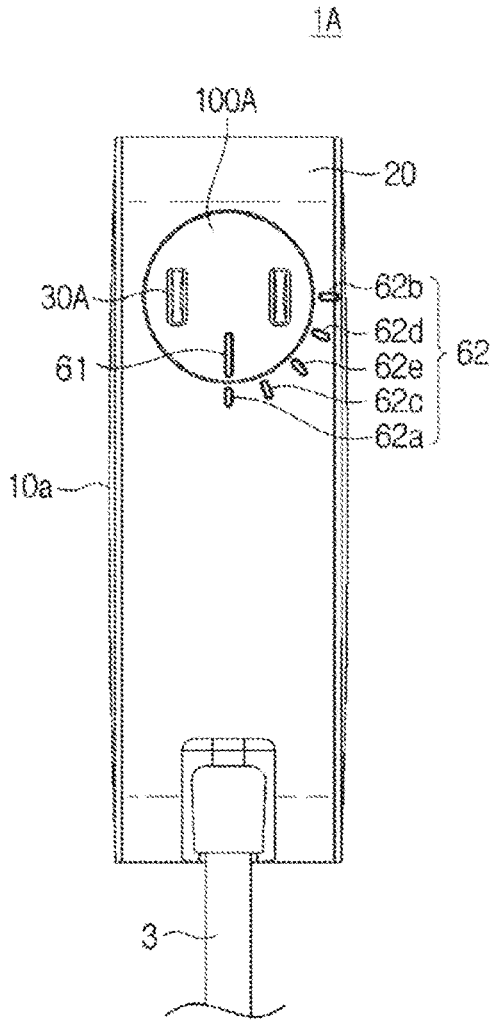

FIGS. 15-17 are views illustrating a rotation step of a connector in accordance with exemplary embodiments.

As illustrated in FIGS. 15-17, the adapter 1A may include a first position indicator 61 to display a rotation state. The first position indicator 61 may be formed on an outer surface of the connector holder 100A.

A second position indicator 62 corresponding to the first position indicator 61 may be formed on the case base 20. The second position indicator 62 may be provided adjacent to an outer circumference of the connector holder 100A to display a rotation angle of the connector holder 100A.

For example, in as shown in FIG. 15, the second position indicator 62 may include a first indicator 62*a* in which the connector holder 100A is not moved, that is the connector holder 100A is at 0 (zero) degrees of rotation, and a second indicator 62*b* in which the connector holder 100A is in a state in which the connector holder 100A is rotated 90 degrees from an initial position.

Alternatively, in another exemplary embodiment shown in FIG. 16, the second display unit 62 may include a first indicator 62*a* in which the connector holder 100A is not moved, that is the connector holder 100A is at 0 (zero) degrees of rotation, a second indicator 62*b* in which the connector holder 100A is in a state in which the connector holder 100A is rotated 90 degrees from an initial position, a third indicator 62*c* in which the connector holder 100A is in a state in which the connector holder 100A is rotated 30 degrees from the initial position, and a fourth indicator 62*d* in which the connector holder 100A is in a state in which the connector holder 100A is rotated 60 degrees from the initial position.

Alternatively, in another exemplary embodiment shown in FIG. 17, the second position indicator 62 may include from a first indicator 62*a*, a second indicator 62*b*, a third indicator 62*c*, a fourth indicator 62*d*, and a fifth indicator 62*e*, wherein each indicator indicates a state in which the connector holder 100A is incrementally rotated 22.5 degrees from an initial position.

According to the exemplary embodiments, the second position indicator 62 may include at least two and up to five indicators including at least one at a rotation angle of 0 (zero) degrees, 22.5 degrees, 45 degrees, 67.5 degrees, and 90 degrees, but embodiments are not limited thereto. For example, a rotation angle of the connector holder may be set and fixed to have a variation.

In addition, the body 10Aa may further comprise a stopper configured to limit a rotation of the connector holder.

According to exemplary embodiments, since the connector 30A and the plug 2 that is coupled to the connector 30A are rotatable due to the rotation of the connector holder 100A, a plurality of the adapters 1A may be installed in the electric outlet 300 disposed to be parallel to each other in various directions and thus the plurality of the adapters 1A may be not interfered with each other.

Therefore, there may be no limitation in the size and the installation direction of the adapter 1A, and thus the usability of the adapter 1A may be improved.

As is apparent from the above description, according to the proposed adapter, the user convenience may be improved due to a rotatable plug.

A plurality of adapters may be used regardless of an arrangement of a multi tap outlet due to a plug that is rotatable by angle and by step-by-step, and thus the user's ease of use may be improved.

In addition, when using a plurality of adapters, a plug may be strongly fixed to a multi tap outlet after being rotated, and thus the reliability may be improved.

Although a few exemplary embodiments have been shown and described, it would be appreciated by those skilled in the art that changes may be made in these embodiments without departing from the principles and spirit of the disclosure, the scope of which is defined in the claims and their equivalents.

What is claimed is:

1. An adapter comprising:

a case having an installation hole which provides access to an interior of the case;

a rotation member installed within the installation hole of the case, the rotation member being rotatable within the installation hole relative to the case;

at least one connection pin installed in the rotation member and protruding from the case;

a guide member provided adjacent to installation hole in the interior of the case and configured to guide rotation of the rotation member;

a printed circuit board (PCB) provided in the interior of the case; and at least one wire is connecting the connection pin to the PCB.

2. The adapter of claim 1, wherein the guide member comprises a cover comprising a wire accommodation unit in which the at least one wire is accommodated.

3. The adapter of claim 2, wherein the cover comprises at least one wire hole through which the at least one wire extends.

4. The adapter of claim 3, wherein the at least one wire comprises two wires that are twisted with each other at least one twist inside the wire accommodation unit.

5. The adapter of claim 1, wherein the rotation member comprises at least one rotation protrusion provided at an outer circumferential surface of the rotation member, and the guide member comprises at least one rotation protrusion groove configured to receive the at least one rotation protrusion.

6. The adapter of claim 5, wherein the case comprises a case body and a case base configured to cover an opening formed in the case body, and the installation hole is formed within the case base.

7. The adapter of claim 6, wherein the rotation member comprises a first position indicator provided on an exterior surface of the rotation member, and the case comprises at least one second position indicator provided on an exterior surface the case, the first position indicator and the at least one second position indicator being configured to indicate a rotation angle of the rotation member.

8. The adapter of claim 7, wherein the at least one second position indicator comprises two indicators spaced apart by 90 degrees.

9. The adapter of claim 1, further comprising a plug configured to be coupled to the connection pin.

10. The adapter of claim 1, wherein the rotation member comprises at least one rotation groove unit provided at an outer circumferential surface of the rotation member, and the guide member comprises at least one rotation protrusion unit disposed on a rotation path of the rotation groove unit, the at least one rotation groove unit being configured to receive the at least one rotation protrusion unit.

11. The adapter of claim 10, wherein the at least one rotation protrusion unit is provided at a position between 0 degrees and 90 degrees.

12. An adapter comprising:

a body;

at least one connector protruding from the body;

a plug connected to the connector;

a printed circuit board (PCB) disposed inside the body;

at least one wire connecting the connector to the PCB; and a connector holder configured to accommodate and support the connector, the connector holder being rotatably installed in the body such that the connector holder is rotatable relative to the body.

13. The adapter of claim 12, further comprising a guide member provided in the body and comprising at least one protrusion groove, wherein the connector holder comprises at least one rotation protrusion formed along an outer circumferential surface of the connecter holder, and the at least one protrusion groove is configured to receive the at least one rotation protrusion.

14. The adapter of claim 12, further comprising a cover coupled to the guide member, wherein the cover comprises a wire accommodation unit in which the at least one wire is accommodated, and the wire accommodation unit has at least one wire hole through which the at least one wire extends.

15. The adapter of claim 12, wherein the at least one wire comprises two wires that are twisted with each other at least one twist inside the wire accommodation unit.

16. An adapter comprising:

a case;

a connector;

a connector holder in which the connector is installed;

a cover configured to accommodate the connector holder inside the case, wherein the connector holder is rotatable relative to the case and the cover; and a printed circuit board (PCB) disposed inside the case and connected to the connector via at least one wire, and wherein the at least one wire is twisted at least once within the cover.

17. The adapter of claim 16, wherein the cover comprises a wire accommodation unit in which the at least one wire is accommodated, and the wire accommodation unit has at least one wire hole through which the at least one wire extends.

* * * * *